United States Patent [19]

Larsson

[11] 4,093,163

[45] June 6, 1978

[54] SWITCH FOR RAIL POINTS

[75] Inventor: Bertil Ivar Larsson, Bredaryd, Sweden

[73] Assignee: Elektromekano i Bredaryd AB, Bredaryd, Sweden

[21] Appl. No.: 758,416

[22] Filed: Jan. 11, 1977

[30] Foreign Application Priority Data

Jan. 19, 1976 Sweden ..... 7600466

[51] Int. Cl.[2] ..... B61L 9/04; B61L 5/06

[52] U.S. Cl. ..... 246/476; 246/220; 246/326; 246/435 R

[58] Field of Search ..... 246/132, 162, 220, 221, 246/326, 273, 379, 393, 405, 415 R, 435 R, 476

[56] References Cited

U.S. PATENT DOCUMENTS

| | | | |
|---|---|---|---|
| 669,816 | 3/1901 | Wrigley | 246/405 |
| 1,293,290 | 2/1919 | Zabel | 246/162 |
| 2,278,213 | 3/1942 | Quenon | 246/476 |
| 2,740,041 | 3/1956 | Marcum | 246/162 X |
| 3,621,237 | 11/1971 | Hylen | 246/393 X |

FOREIGN PATENT DOCUMENTS

| | | | |
|---|---|---|---|
| 91,965 | 6/1897 | Germany | 246/353 |

*Primary Examiner*—Stephen G. Kunin
*Attorney, Agent, or Firm*—Newton, Hopkins & Ormsby

[57] ABSTRACT

In a switch for rail points arranged to move two rails interconnected at one of their free ends, between two end positions in engagement with the inner face of one of two rails of e.g. a railroad track, a box girder having the configuration and dimensions of a conventional sleeper supporting the rail track, the box girder housing an electrically driven mechanism arranged to effect the movement of the two rails to the end positions thereof, and also a mechanism arranged to indicate when the two rails assume their intended end positions.

7 Claims, 8 Drawing Figures

Fig.8
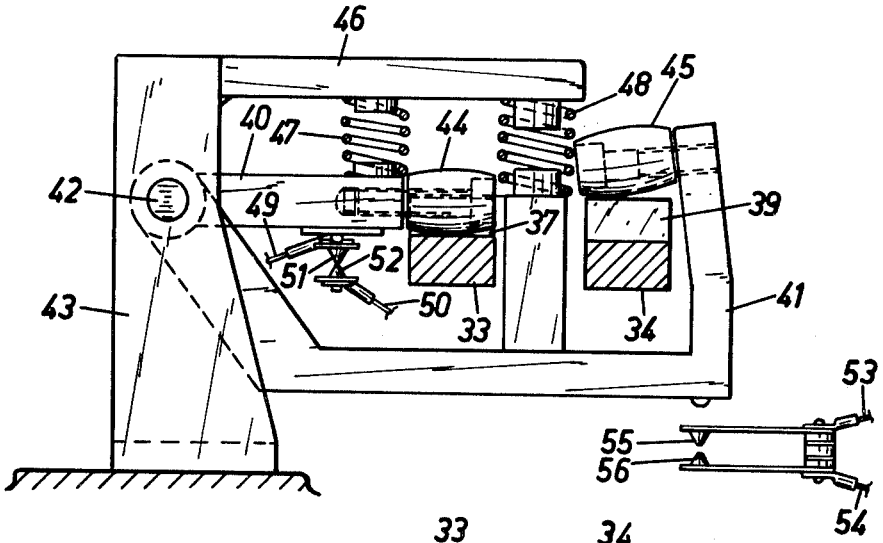
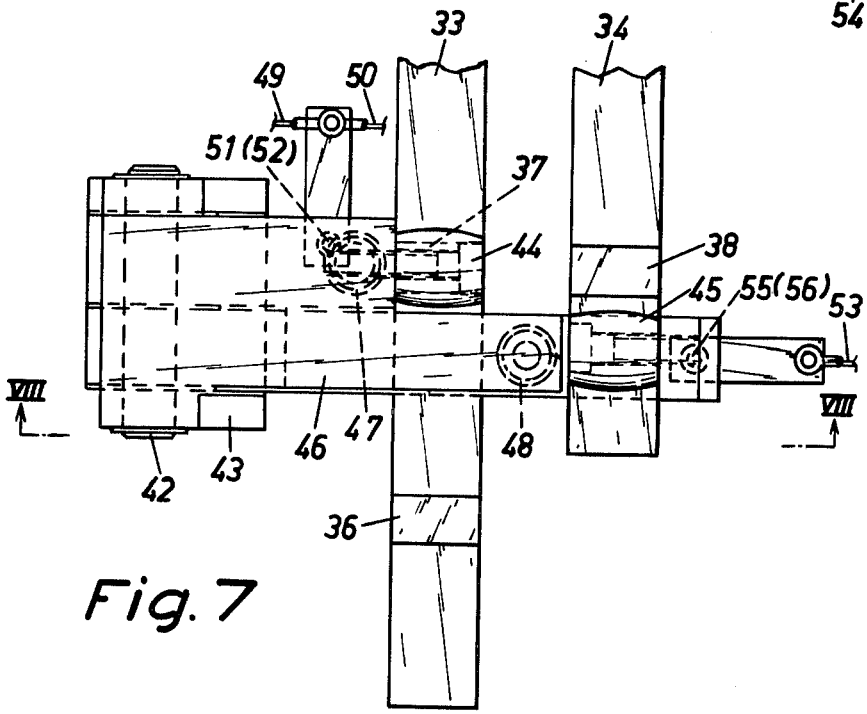
Fig. 7

SWITCH FOR RAIL POINTS

BACKGROUND OF THE INVENTION

The present invention relates to a switch for rail points, designed to shift a switch blade consisting of two rails which are interconnected at their free ends, between end positions into abutment alternatively against one or the other of the rails of a (railway) track.

SUMMARY OF THE INVENTION

It is characteristic of the invention that an electrically operated mechanism adapted to shift the switch blade to the end positions thereof and a mechanism adapted to indicate the switch blade positions, are housed in a box girder having the configuration of a sleeper supporting the rail track.

An essential advantage gained by the invention is that because the entire mechanism to shift the switch blade and the mechanism to indicate the switch blade positions are housed inside one and the same box girder the dimensions of which essentially agree with those of a convential sleeper, there are no problems of compacting the macadam on the railroad bed in the area of the switch.

In accordance with a suitable embodiment of the invention the mechanism adapted to shift the switch blade comprises a sleeve having a helical groove therein, said sleeve being rotatably driven by an electric motor via a gear mechanism and preferably separately via a torque converter, but being axially non-displaceably mounted, a guide pin passing through said helical groove so as to serve as a follower means and having its inner end secured to a rod which passes axially through the sleeve and is connected to the switch blade, the outer end of said pin being guided in a linear, stationary track. A mechanism designed in this manner ensures efficient shifting of the switch blade to the two end positions thereof while requiring comparatively little energy.

In accordance with a further embodiment of the invention the ends of the helical groove in the sleeve may terminate in prolonged sections which extend in a plane crossing the longitudinal extension of the sleeve at right angles, whereby is ensured that the switch blade is locked in its end positions, eliminating the risk that the switch blade be dislocated from its end positions as a result of vibrations of the rails, caused e.g. by very rapid trains passing thereon.

DESCRIPTION OF THE DRAWINGS

Further characteristics of the invention will appear from the following description with reference to the accompanying drawings, wherein

FIG. 7 is a plan view of the mechanism designed to indicate the end positions of the switch blade.

FIG. 8 is a cross-sectional view through this mechanism along line VIII—VIII of FIG. 7.

DETAILED DESCRIPTION OF A PREFERRED EMBODIMENT

Figure 1:
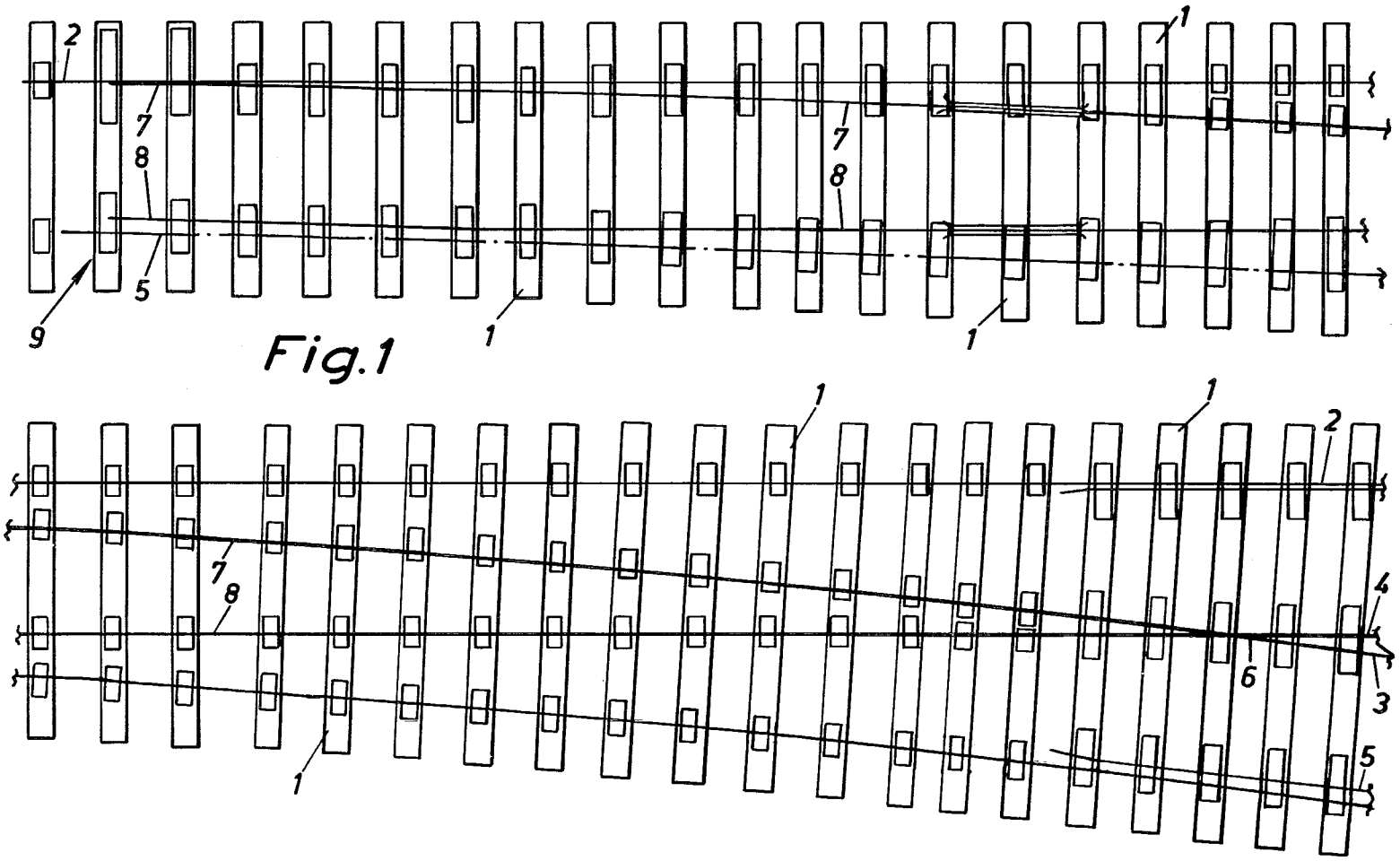
FIG. 1 is a plan view of a switch for rail points, the upper view being the continuation of the railway track shown in the lower view.
Figure 3:
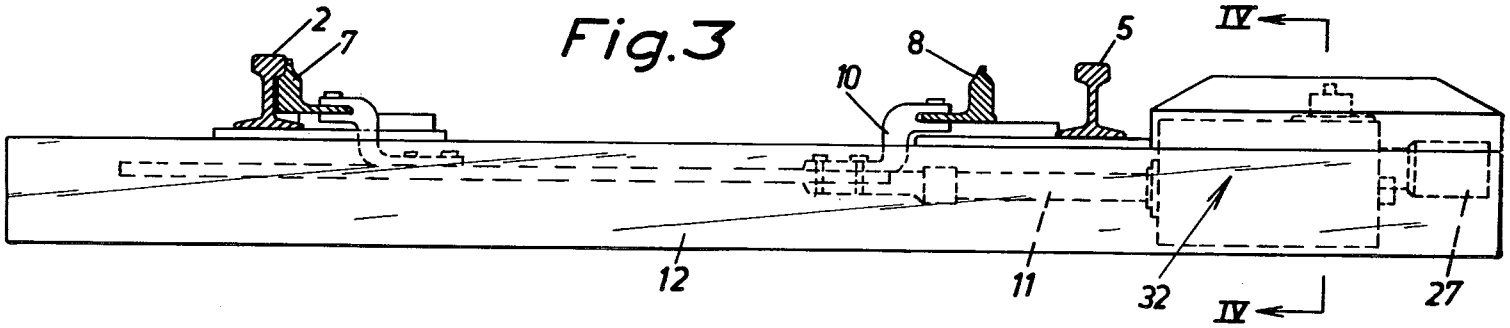
FIG. 3 illustrates a vertical sectional view through the railway track and in a lateral view the box girder housing the mechanism of the rail point switch.

In FIG. 1, the two rails forming a railway track and supported by sleepers 1 are designated by numeral references 2 and 3, and the two rails forming a branch track are designated by references 4 and 5. At the branching point 6 proper, two rails 7 and 8, forming a switch blade, extend to the left, and at the switching point 9 proper, these rails are interconnected and may be shifted to different end positions as will be explained in closer detail in the following.

Figure 2:
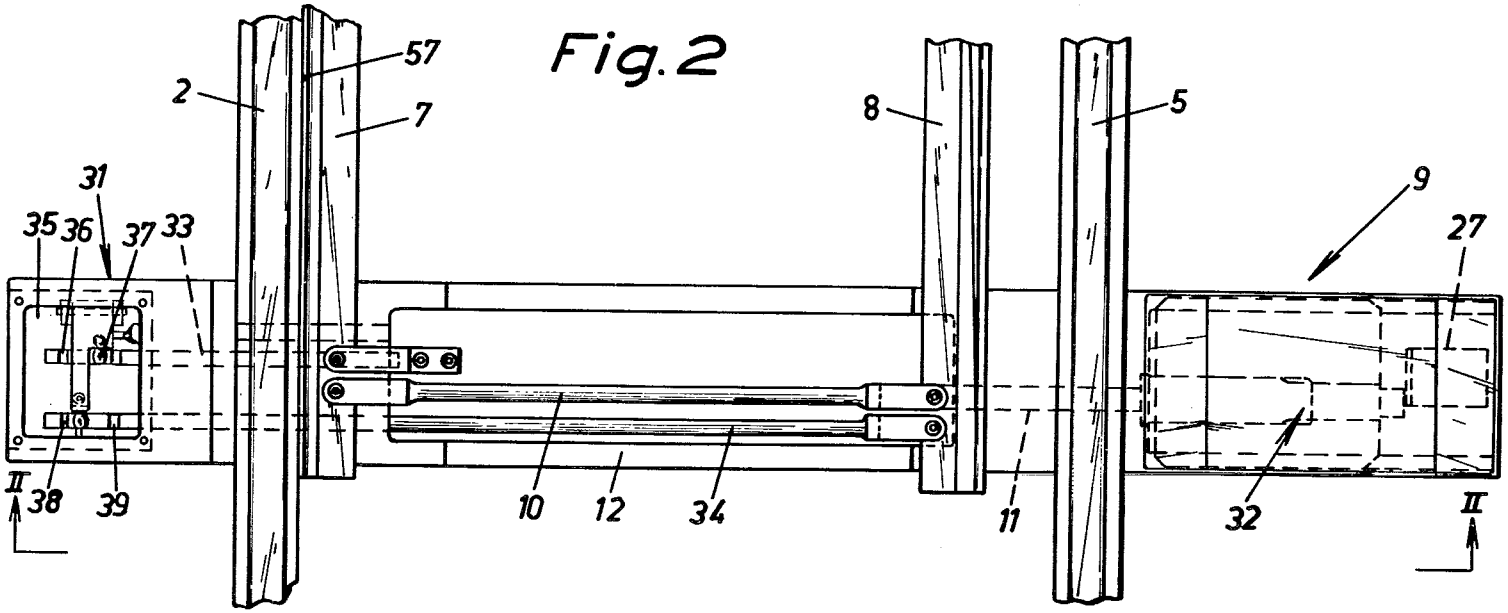
FIG. 2 illustrates on an enlarged scale a plan view of the mechanism of the rail point switch and the free end of the switch blade.

As appears from FIG. 2, the rails 7 and 8 are interconnected at the switching point 9 by a rod 10 which in turn is connected to a coupling rod 11. The latter extends in the lengthwise direction of a box girder 12 the dimensions of which substantially agree with those of a conventional sleeper. The right-hand end of the coupling rod 11 extends axially through a sleeve 13 which is rotatably but axially non-displaceably mounted in the right-hand end of the box girder, said sleeve 13 formed with a helical groove 14 therein extending through one turn of the sleeve and formed at its ends with prolonged sections 15, 16 which extend in a plane at right angles to the longitudinal extension of the sleeve. A guide pin 17, serving as a follower means, passes through the groove 14, and the inner end 18 of the pin is screwed at right angles into the rod 11, whereas the outer end 19 thereof is guided in a track 20 which extends in the longitudinal direction of the rod 11 in the box girder 12. A worm wheel 21 is attached on the sleeve 13 and is driven by a screw worm 22 arranged on a shaft 23 which is rotatably mounted in the box girder in a vertical position. On the shaft 23 is arranged a worm wheel 24 which is driven by a screw worm 25 mounted on the shaft 26 of an electric motor 27. The electric motor is reversible and thus may drive the sleeve 13 alternatingly in both directions.

In emergency, the sleeve 13 may also be driven manually by means of a crank 28 via a torque converter 29 mounted on an extension 30 on the shaft 23.

Figure 4:
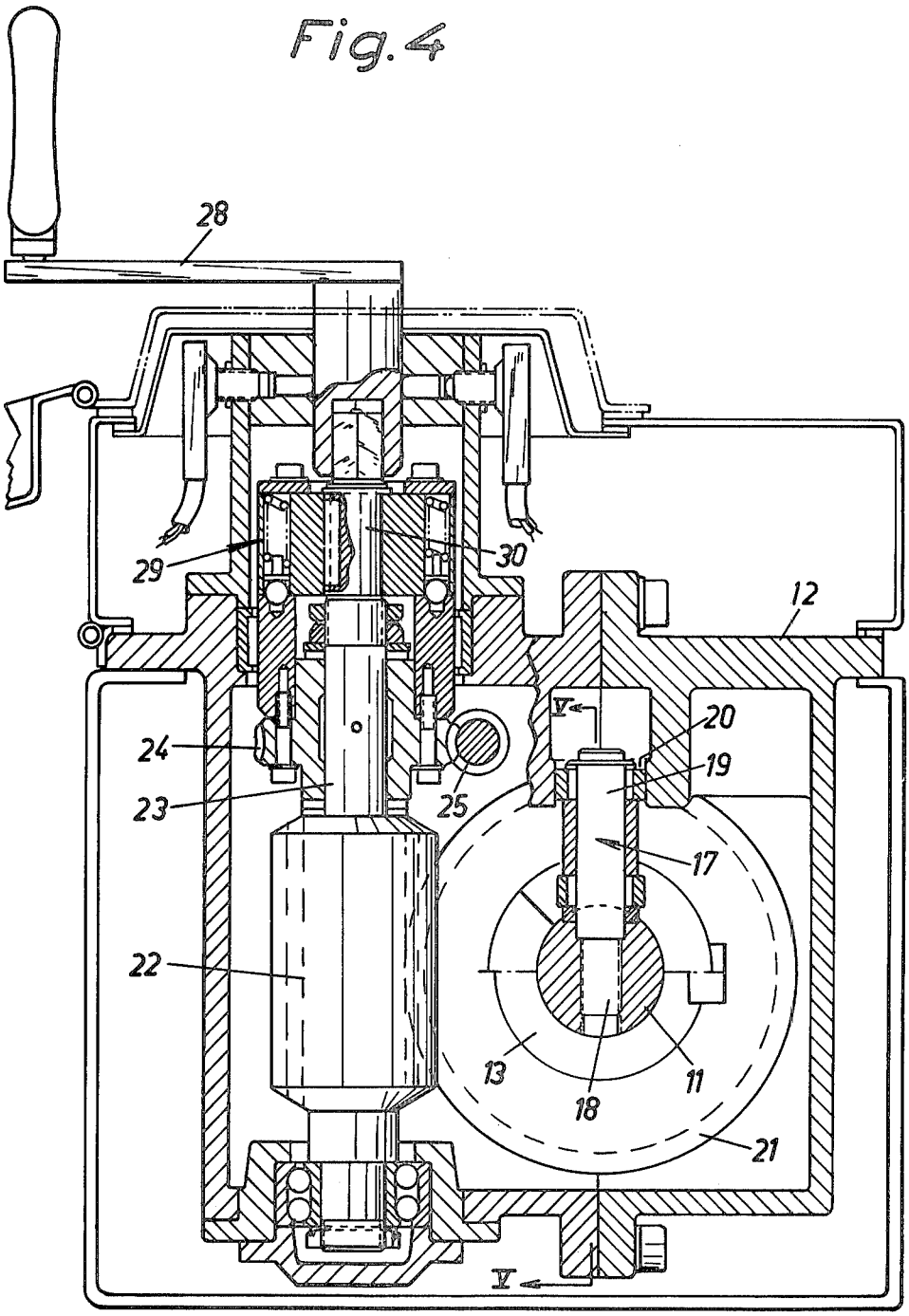
FIG. 4 illustrates on a further enlarged scale a cross-sectional view through the box girder along line IV—IV of FIG. 3.
Figure 5:
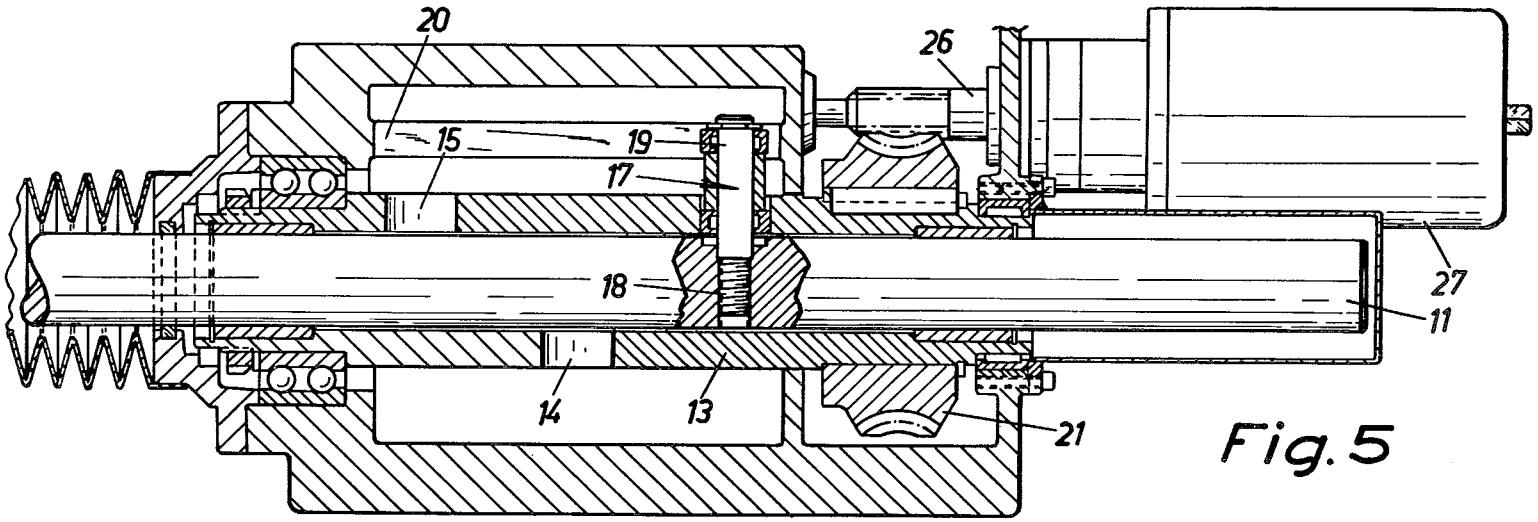
FIG. 5 shows on a somewhat reduced scale a cross-sectional view along line V—V of FIG. 4.
Figure 6:
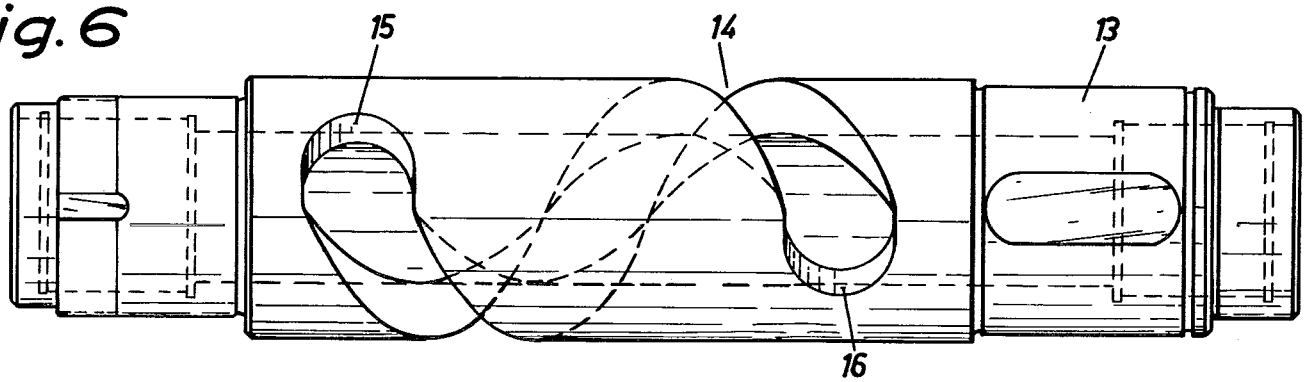
FIG. 6 is a side view of the sleeve having a helical groove therein and being incorporated in the switch mechanism.

When the sleeve 13 is turned, the rod 11 is forced by the pin 17 to move axially inside the sleeve, bringing along the switch blade 7, 8. Upon rotation of the sleeve 13 to the right in accordance with FIGS. 4 and 6, the switch blade 7, 8 will move from the position illustrated in FIG. 2 in which the rail 7 abuts against the inner face of the rail 2, to its right-hand end position (not shown), in which position the rail 8 will abut against the inner face of the rail 5. Owing the engagement of the guide pin 17 in the prolonged sections 15, 16 of the track 14 at the end of the rotation of the sleeve 13, the switch blade 7, 8 is effectively locked in its end positions.

It is of course of importance that means are provided to establish from a distance whether or not the switch blade 7, 8 assumes its correct end position after the switching, and for this purpose the rail point switch also includes a mechanism designed to indicate the end positions of the switch blade. This indicating mechanism 31 is housed inside the box girder 12 at the end thereof opposite the one, where the mechanism 32 arranged to shift the switch blade 7, 8 is positioned.

The indicating mechanism comprises two indicating rods 33, 34 one end of which is attached to its associated one of the rails 7 and 8. The rods extend in the longitudinal direction of the box girder 12 into a chamber 35 formed in the afore-mentioned end of the box girder. Each indicating rod 33, 34 is formed with two transverse recesses 36, 37 and 38, 39, respectively. With each one of the rods 33, 34 cooperates the associated one of arms 40, 41 said arms having one of its ends pivotally mounted about a horizontal shaft 42 arranged on a stand 43 inside the chamber 35, whereas the opposite end of each arm supports one roller each, designated respectively 44 and 45, which rollers, upon axial displacement of the rods 33, 34, roll thereon. Between an overhang 46 on the stand 43 and each one of arms 40, 41 is held a helical spring 47 and 48, respectively, which springs maintain their associated one of rollers 44, 45 on the arms 40, 41 in a position pressed tightly against the upper face of the respective rod 33, 34. Beneath the arm 40 are positioned switches 51, 52 connected to electrical wires 49, 50, and beneath the arm 41 are positioned switches 55, 56 connected to electrical wires 53, 54. The switches 51, 52 and 55, 56 are connected to separate indicating circuits.

The notches 37, 39 are arranged in such positions on the indicating rods 33, 34 as to ensure that upon shifting of the switch blade 7, 8 to the left end position thereof (FIG. 2), they will be positioned exactly beneath the rollers 44, 45, the latter then being forced down into the notches 36, 38 by their own weight, and with the aid of the springs 47, 48. The arms 40, 41 are then pivoted in the clockwise direction as seen in FIG. 8, closing the switches 51, 52 and 55, 56 of their respective one of the indicating circuits, and as a result an optical and/or acoustic signal is emitted, indicating that the switch blade assumes the correct position. On the other hand, if a hard object happens to be positioned in the gap 57 between the rails 2 and 7, making it impossible to shift the switch blade to the end position illustrated in FIG. 2, the indicating rods 33, 34 will not be displaced sufficiently far to the left for the notches 37, 39 to assume their positions exactly beneath the rollers 44, 45 and consequently no indicating signal will be emitted. The fault naturally must be remedied before the train is allowed to pass.

FIG. 8 shows the situation when only indicating rod 33 is in the left end position according to FIG. 2, indicating that the rail 7 is in the correctly shifted position. On the other hand, rod 34 indicates that the rail 8 does not assume the correct position. This must be due to some fault, for instance that the connective rod 10 between the rails 7, 8 has come loose or that the coupling rod 11 is not intact, possibly due to the guide pin 17 having broken. The rail point therefore must be checked and repaired.

When the switch blade 7, 8 is shifted to the opposite end position (right-hand end position in accordance with FIG. 2), the indicating rods 33, 34 are displaced to the right — provided everything is in order — until the recesses 36, 38 assume a position opposite the rollers 44, 45, in which case the indication signals are emitted in the predetermined manner.

The embodiment as described and illustrated is to be regarded as an example only and the various parts of the rail point switch may be constructively altered in a variety of ways within the scope of the appended claims. This is true both as concerns the mechanism 32 to shift the switch blade 7, 8 to the two end positions thereof and the mechanism 31 to indicate the correctly shifted positions. In this case it is essential only that the two mechanisms 31, 32 are arranged in one and the same box girder 12 serving as a sleeper. The rail point switch may be used for other tracks than railroad tracks. In case the box girder 12 housing the mechanisms 31 and 32 is positioned approximately halfway between the switching point 9 and the branching point 6, the groove 14 in the sleeve need extend through half a turn only to the sleeve.

What I claim is:

1. An improved switch for rail points arranged to shift a switch blade consisting of two rails interconnected at corresponding free ends to end positions, alternately in engagement with the inner face of one of two railroad track rails, said railroad track rails resting on substantially equidistantly spaced sleepers, the improvement comprising a hollow box girder forming a housing and having substantially the external dimensions of one of said sleepers and positioned in the location of a sleeper in spaced relation to a pair of adjacent sleepers, an electrically powered mechanism positioned within said housing and connected with said switch blade to shift the switch blade to said end positions, and an associated switch blade end position indicator mechanism within said housing and having a connection with said electrically powered mechanism, the arrangement being such that the railroad bed areas between said housing and the adjacent pair of sleepers is unobstructed.

2. An improved switch for rail points according to claim 1, wherein said electrically powered mechanism is disposed within one end portion of said housing and said indicator mechanism is disposed in the other end portion of said housing.

3. An improved switch for rail points according to claim 1, wherein each rail of said switch blade includes a lateral rod arranged for longitudinal displacement and projecting into said housing adjacent to said indicator mechanism, a positioning means on each of said rods, and a coacting spring-urged rod position sensing means for each rod including an electrical indicator switch, whereby when said two rails of the switch blade are shifted correctly to their end positions said electrical switches close circuits to two indicator means.

4. An improved switch for rail points arranged to shift a switch blade consisting of two rails interconnected at corresponding free ends to end positions, alternately in engagement with the inner face of one of two railroad track rails, said railroad track rails resting on substantially equidistantly spaced sleepers, the improvement comprising a hollow box girder forming a housing and having substantially the external dimensions of one of said sleepers and positioned in the location of a sleeper in spaced relation to a pair of adjacent sleepers, an electrically powered mechanism positioned within said housing and connected with said switch blade to shift the switch blade to said end positions, an associated switch blade end position indicator mehanism within said housing and having a connection with said electrically powered mechanism, the arrangement being such that the railroad bed areas between said housing and the adjacent pair of sleepers is unobstructed, and said electrically powered mechanism comprising a sleeve mounted for rotation and held against axial displacement, an electric motor to drive the sleeve in rotation through a gear mechanism, a torque converter, said sleeve also being drivable in rotation by said torque converter, said sleeve having a helical groove formed therein, a guide pin serving as a follower engaging through said helical groove, a rod extending axially through said sleeve, and a linear stationary track, the inner end of said guide pin being secured to said rod and the outer end of said guide pin being guided in said linear stationary track.

5. An improved switch for rail points according to claim 4, wherein the ends of said helical groove formed in said sleeve extend in a plane crossing said sleeve approximately at right angles.

6. An improved switch for rail points according to claim 4, wherein said helical groove extends through an entire turn of the sleeve.

7. An improved switch for rail points according to claim 5, wherein said helical groove extends through an entire turn of the sleeve.

* * * * *